US005786669A

United States Patent [19]

Kobori et al.

[11] Patent Number: 5,786,669

[45] Date of Patent: Jul. 28, 1998

[54] CRT ELECTRON GUN WITH LUMINANCE CONTROLLED BY A MINIMUM SPOT DIAMETER AGGREGATE OF FIELD EMISSION CATHODES

[75] Inventors: Yoichi Kobori; Koji Onodaka; Katsuya Hiraga, all of Mobara, Japan

[73] Assignee: Futaba Denshi Kogyo K.K., Mobara, Japan

[21] Appl. No.: 970,194

[22] Filed: Nov. 14, 1997

Related U.S. Application Data

[63] Continuation of Ser. No. 391,026, Feb. 21, 1995, abandoned.

[30] Foreign Application Priority Data

Feb. 21, 1994 [JP] Japan ..... 6-022366
Mar. 2, 1994 [JP] Japan ..... 6-032497

[51] Int. Cl.[6] ..... H01J 29/52

[52] U.S. Cl. ..... 315/169.3; 315/366; 345/12; 345/74; 345/149

[58] Field of Search ..... 315/169.1, 169.2, 315/169.3, 169.4, 366; 348/687, 805; 313/495, 496, 497; 345/12, 63, 74, 75, 77, 149

[56] References Cited

U.S. PATENT DOCUMENTS

| | | | |
|---|---|---|---|
| 4,857,799 | 8/1989 | Spindt et al. | 313/495 |
| 5,068,579 | 11/1991 | Tomii et al. | 315/366 |
| 5,103,144 | 4/1992 | Dunham | 315/366 |
| 5,103,145 | 4/1992 | Doran | 315/366 X |
| 5,363,021 | 11/1994 | MacDonald | 315/366 |

*Primary Examiner*—Robert J. Pascal
*Assistant Examiner*—Justin P. Bettendorf
*Attorney, Agent, or Firm*—Oblon, Spivak, McClelland, Maier & Neustadt, P.C.

[57] ABSTRACT

An electron gun and a CRT capable of accomplishing a reduction in spot diameter of electron beams, an increase in drive speed and control of luminance while being simplified in structure. Field emission cathodes acting as the electron source for the electron gun are arranged in the form of or divided into plurality of the small regions S for matrix driving, to thereby control luminance of the CRT depending on the number of small regions S selected. Thus, luminance control over any desired number of gradations which exhibits satisfactory resistance to noise and linearity can be realized while simplifying the structure, resulting in the field emission cathodes being highly conveniently applied to the electron gun of the CRT, leading to an improvement in functionality of the CRT.

7 Claims, 5 Drawing Sheets

CRT ELECTRON GUN WITH LUMINANCE CONTROLLED BY A MINIMUM SPOT DIAMETER AGGREGATE OF FIELD EMISSION CATHODES

This application is a continaution of application Ser. No. 08/391.026, filed on Feb. 21, 1995, now abandoned.

BACKGROUND OF THE INVENTION

This invention relates to an electron gun, a cathode ray tube and a method for driving the cathode ray tube, and more particularly to an electron Sun having field emission cathodes acting as an electron source incorporated therein, a cathode ray tube including such an electron gun and a method for driving the cathode ray tube.

A conventional cathode ray tube (hereinafter also referred to as "CRT") is typically constructed in such a manner as shown in FIG. 7. More specifically, a CRT, generally designated at reference numeral 1 in FIG. 7 includes a neck section 3 provided with an electron gun 2, a funnel section 5 provided with a deflection electrode for deflecting electron beams emitted from the neck section 3, and a panel section 6 having phosphors deposited thereon and excited for luminescence by the electron beams.

The electron gun 2 incorporated in the CRT 1 is generally constructed as shown in FIG. 8. The conventional electron gun 2 includes a cathode 7 of the indirectly heated type for beating an oxide layer by means of a heater a lead-out electrode 8 and a focusing electrode 9.

In the conventional CRT 1 constructed as described above, electron beams emitted from the electron gun 2 of the neck section 3 and focused are directed to a predetermined position on the panel section 6 by the deflection electrode 4 of the funnel section 5, to thereby cause the phosphors to be excited for luminescence, resulting in providing desired display.

Unfortunately, the CRT 1 having the conventional electron gun 2 incorporated therein has problems.

One of the problems is that a beater power supply is required for heating the heater because the cathode of the electron gun is of the indirectly heated type.

Another problem encountered with the conventional CRT is that a certain length of time is required from turning-on of the heater power supply to emission of the electron beams.

The CRT has a further disadvantage that the heater of the electron gun fails to exhibit satisfactory durability, to thereby fail to permit the GRT to exhibit increased durability.

Still another problem of the conventional CRT is that ant electron source capable of emitting electron beams of increased current density is not substantially available, although the CRT requires it.

Further, in the conventional CRT, an electron emission section of the electron gun must be formed into a diameter as large as several millimeters. Thus, focusing of the electron beams to a certain degree by means of an electron lens system causes the beams to be deformed due to aberration and electron density in a diameter of the beams to be non-uniform.

In order to solve the above-described problems, CRTs which have field emission cathodes (hereinafter also referred to as "FECs") incorporated therein for an electron emission section of an electron gun were proposed while taking notice of the fact that the FEC exhibits advantages of eliminating a necessity of such a heater as described above and increasing current density.

One of such CRTs proposed is so constructed that PEC cells are classified into a plurality of groups different in the number of cells and in a binary relation and each group of FEC cells are successively connected to each other. The groups are driven in different combinations to realize various levels of brightness or luminance.

In the proposed CRT thus constructed, it is required to arrange, within a limited range, a plurality of the FEC cell groups each comprising a plurality of PEC cells connected to each other in a predetermined pattern. Such complicated arrangement leads to an increase in manufacturing cost. Also, selection of the FEC cell groups or a combination thereof often leads to a failure in concentration of the driven PEC cells in a narrowed range, resulting in gaps being formed between the PEC cells driven. This causes the electron emission section of the electron gun to be considerably increased in diameter, leading to deformation of the electron beams due to aberration and non-uniform electron density in the beam diameter.

SUMMARY OF THE INVENTION

The present invention has been made in view of the foregoing disadvantage of the prior art.

Accordingly, it is an object of the present invention to provide an electron gun which is capable of accomplishing a reduction in spot diameter of electron beams, an increase in drive speed and control of luminance while being simplified in structure.

It is another object of the present invention to provide a cathode ray tube including an electron gun which is capable of accomplishing a reduction in spot diameter of electron beams, an increase in drive speed and control of luminance while being simplified in structure.

It is a further object of the present invention to provide a method for driving a cathode ray tube including an electron gun which is capable of accomplishing a reduction in spot diameter of electron beams, an increase in drive speed and control of luminance while being simplified in structure.

In accordance with one aspect of the present invention, an electron gun is provided. The electron gun comprises field emission cathodes each including a cathode conductor, emitters provided on the cathode conductor and a gate disposed in proximity to the emitters. The field emission cathodes are arranged in the form of small regions defined in a matrix-like manner.

In a preferred embodiment of the present invention, the gate of each of the field emission cathodes includes a luminance control means to which a signal depending on luminance data fed to a cathode ray tube is applied to adjust luminance.

In accordance with this aspect of the present invention, an electron gun is provided. The electron gun comprises field emission cathodes each including a cathode conductor, emitters provided on the cathode conductor and a gate disposed in proximity to the emitters. The field emission cathodes are arranged in the form of small regions defined in a matrix-like manner. The cathode conductor and gate of each of the small regions are driven for every row or column of the matrix.

In accordance with this aspect of the present invention, an electron gun is provided. The electron gun comprises field emission cathodes each including a cathode conductor, emitters provided on the cathode conductor and a gate disposed in proximity to the emitters. The field emission cathodes are arranged in the form of small regions defined in a matrix-like manner. The small regions are arranged in such a manner that a part thereof is outwardly projected from an outer edge of the remaining part thereof. The cathode conductor and gate of each of the small regions are driven for every row or column of the matrix.

In accordance with another aspect of the present invention, a cathode ray tube is provided. The cathode ray tube comprises an electron gun including field emission cathodes each including a cathode conductor, emitters provided on the cathode conductor and a gate disposed in proximity to the emitters. The field emission cathodes are arranged in the form of small regions defined in a matrix-like manner. The cathode ray tube also comprises a deflection electrode for deflecting electron beams emitted from the electron gun, a panel section having phosphors which emit light due to impingement of electron beams thereon deposited thereon, and a luminance control means for driving the cathode conductor and gate of each of the small regions for every row or column of the matrix in the electron gun to control a drive area of each of the field emission cathodes, resulting in controlling luminance.

In a preferred embodiment of the present invention, the luminance control means adjusts luminance by controlling the drive area of each of the field emission cathodes and concurrently applying a signal depending on luminance data to the gate of each of the field emission cathodes.

In a preferred embodiment of the present invention, luminance control means adjusts luminance by controlling the drive area of each of the field emission cathodes and concurrently applying a signal of which a pulse width is modulated depending on luminance data or a signal of a voltage depending on the luminance data to the gate of each of the field emission cathodes in synchronism with a control signal of the deflection electrode.

In accordance with a further aspect of the present invention, a method is provided for driving a cathode ray tube which includes an electron gun including a plurality of field emission cathodes each including a cathode conductor, emitters provided on the cathode conductor and a gate disposed in proximity to the emitters and arranged in the form of small regions defined in a matrix-like manner, a deflection electrode for deflecting electron beams emitted from the electron gun and a panel section having phosphors which emit light due to impingement of electron beams thereon deposited thereon. The method comprises the step of driving the cathode conductor and gate of each of the small regions for every row or column of the matrix in the electron gun to control a drive area of each of the field emission cathodes, resulting in controlling luminance.

In a preferred embodiment, luminance control is carried out by driving the cathode conductor and gate of each of the small regions for every row or column of the matrix in the electron gun to control a drive area of each of the field emission cathodes and applying a signal of which a pulse width is modulated depending on luminance data or a signal of a voltage depending on the luminance data to the gate of each of the field emission cathodes in synchronism with a control signal of the deflection electrode.

In accordance with this aspect of the present invention, a method is provided for driving a cathode ray tube which includes an electron gun including a plurality of field emission cathodes each including a cathode conductor, emitters provided on the cathode conductor and a gate disposed in proximity to the emitters and arranged in the form of small regions defined in a matrix-like manner, a deflection electrode for deflecting electron beams emitted from the electron gun, a panel section having phosphors which emit light due to impingement of electron beams thereon deposited thereon and a luminance control means for. driving the cathode conductor and gate of each of the small regions for every row or column of the matrix in the electron gun to select the small regions. The method comprises the step of controlling a drive area of each of the field emission cathodes to control luminance.

BRIEF DESCRIPTION OP THE DRAWINGS

These and other objects and many of the attendant advantages of the present invention will be readily appreciated as the same becomes better understood by reference to the following detailed description when considered in connection with the accompanying drawings, wherein.

DETAILED DESCRIPTION OF THE PREFERRED EMBODIMENTS

Now, the present invention will be described hereinafter with reference to FIGS. 1 to 6.

Figure 7:
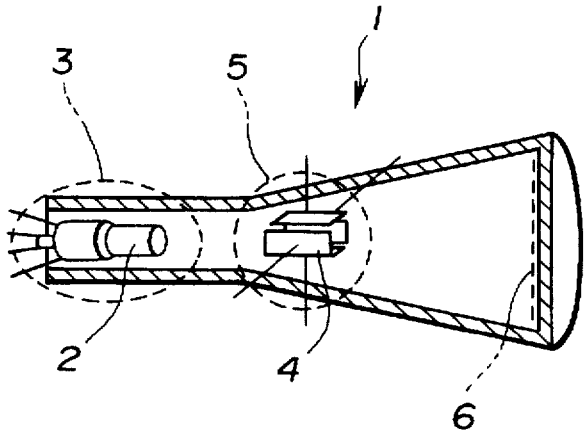
FIG.7 PRIOR ART
FIG. 7 is a sectional view generally showing a conventional cathode ray tube.
Figure 8:
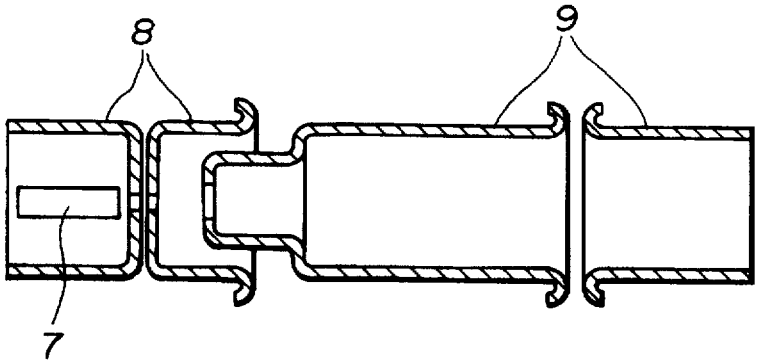
FIG.8 PRIOR ART
FIG. 8 is a sectional view showing a conventional electron gun.

Referring first to FIGS. 1 to 4, an embodiment of a CRT according to the present invention is illustrated. A CRT of the illustrated embodiment which is generally designated by reference numeral 10 may be basically constructed in substantially the same manner as the conventional CRT described above with reference to FIG. 7. The CRT 10 of the illustrated embodiment includes a glass vessel 11 provided with a neck section 11*a*. The neck section 11*a* is provided therein with an electron gun 12 for emitting electrons, which are then deflected by a deflection electrode 37 of a funnel section as in the prior art described above. Then, the electron beams are permitted to impinge on phosphors of a panel section on an inner surface of a front portion of the glass vessel 11, resulting in desired image display being carried out, as in the prior art.

The electron gun 12 of the CRT 10 includes field emission cathodes 20 acting as an electron source, unlike the conventional CRT 1. Thus, the electron gun 12 includes the cathode emission cathodes 20, and first and electron beam focusing electrodes 25 and 28.

Figure 1:
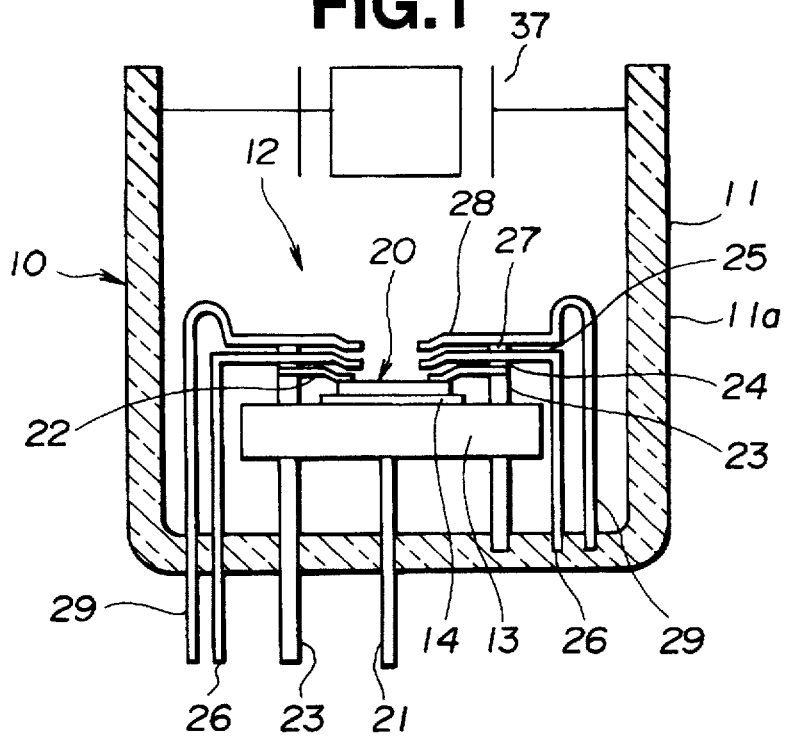
FIG. 1 is a sectional view showing an electron gun incorporated in an embodiment of a CRT according to the present invention.
Figure 2:
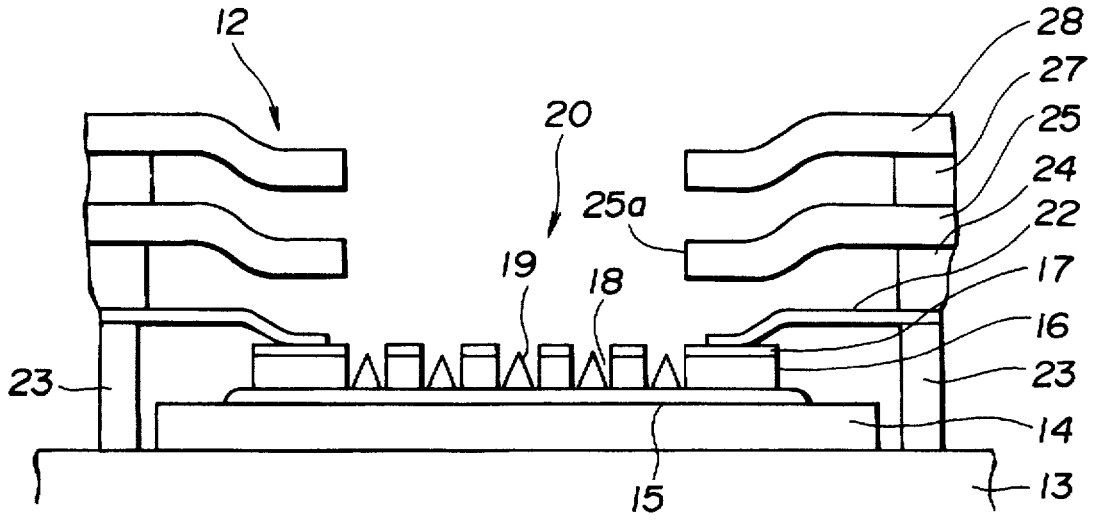
FIG. 2 is a fragmentary enlarged view showing an essential part of the electron gun of FIG. 1.

Now, the electron gun 12 will be more detailedly described with reference to FIG. 2.

The electron gun 12 includes a ceramic base plate 13, which is provided thereon with a substrate 14 made of an insulating material such as Si, glass or the like. The substrate 14 is provided thereon with a plurality of Spindt-type field emission cathode or FECs 20 in a range of about 0.5 to 0.6 mm in diameter. More particularly, the PECs 20 each include a cathode conductor 15 made of a conductive film formed on the substrate 14, and an insulating layer 16 and a gate 17 laminatedly formed on the cathode conductor 15. The insulating layer 16 and gate 17 are formed with common through-holes 18 by photolithography, in which emitters 19 are respectively formed by vapor deposition while being arranged on the cathode conductor 15.

In the illustrated embodiment, the emitter 19 is of the Spindt type formed by deposition. Alternatively, it may be in the form of a vertical-type field emission emitter formed by etching. Also, it may be in the form of a flat-type field emission emitter so long as it exhibits satisfactory directionality.

The cathode conductor 15 of each of the FECs 20 is connected to a cathode stem 21 arranged on the ceramic base plate. 13, which cathode stem is led out through the neck section 11*a* of the glass vessel 11. The gate 17 of each of the PECs 20 has a plate-like conductor 22 formed at a central portion thereof with an aperture. The conductor 22 is then connected at each of both ends thereof to one end of each of two gate stems 23 arranged so as to extend through the ceramic base plate 13 toward the FEC 20. At least one of the gate stems 23 is outwardly projected through the neck section lha of the glass vessel 11.

Above the ceramic base plate 13, the conductor 22 is formed thereon with an insulating layer 24, which is then provided thereon with the first electron beam focusing electrode 25 briefly described above. The first electron beam focusing electrode 25 is made of a metal sheet and formed at a central portion thereof with an aperture 25*a* of 0.5 to 0.6 mm in diameter. Also, the first electron beam focusing electrode 25 is arranged in such a manner that a distance between a portion of the electrode 25 at which the aperture 25*a* is formed and the gate 17 is set to be 0.08 to 0.1 mm. Also, the first electron beam focusing electrode 25 is supported at both ends thereof on rod-like lead terminals 26, of which at least one is led out through the glass vessel 11.

The electron gun 12 also includes a second electron beam focusing electrode 28 arranged on the first electron beam focusing electrode 25 through a ceramic insulating material 27 of 0.1 to 0.2 mm in thickness. The second electron beam focusing electrode 28 may be constructed in substantially the same manner as the first electron beam focusing electrode 25 and includes lead terminals 29 of which at least one Is led out through the glass vessel 11.

The CRT 10 of the illustrated embodiment constructed as described above includes a circuit for applying a voltage of a predetermined level to each of the electrodes of the electron gun 12. For this purpose, the illustrated embodiment may be so constructed that the emitters 19 each are grounded and the gate 117, first electron beam focusing electrode 25 and second electron beam focusing electrode 28 have voltages of 30 to 150 V, 0 to 150 V and 200 to 500 V applied thereto, respectively.

Alternatively, the gate 17 may be grounded while applying the above-described voltage to each of the electrodes. Also, in the illustrated embodiment, the electron gun 12 includes the FECs 20 and the first and second electron beam focusing electrodes 25 and 28. Alternatively, it may further include third and fourth focusing electrodes as required.

Figure 3:
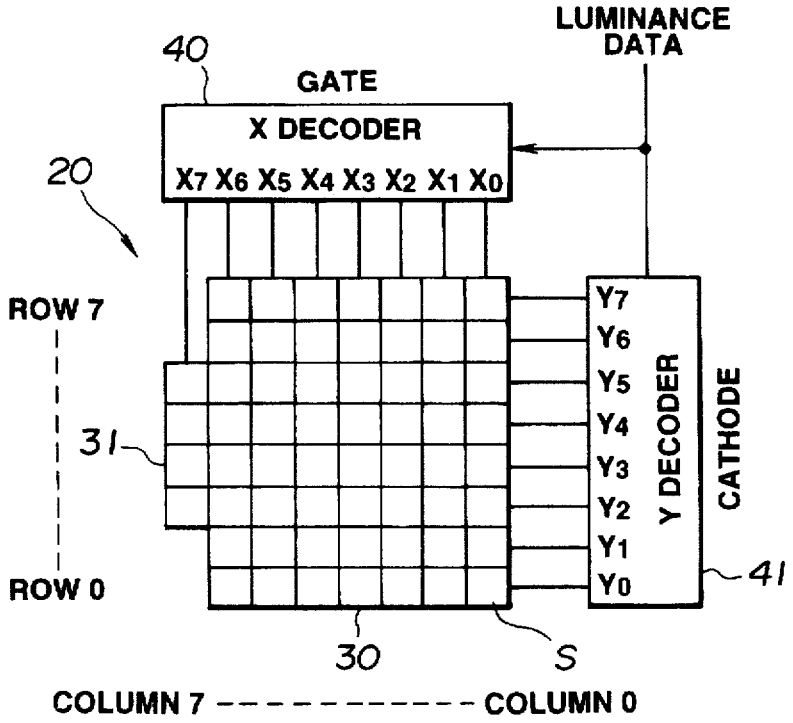
FIG. 3 is a block diagram showing driving of FECs incorporated in an embodiment of a CRT according to the present invention.

In the illustrated embodiment, the FECs 20, as shown in FIG. 3, are arranged in the form of or divided into a plurality of small regions S. The small regions S are arranged in a manner like a matrix consisting of eight rows of from rows 0 to 7 and eight columns of from columns 0 to 7. In the illustrated embodiment, the term "row" is defined in a lateral direction of the matrix and the term "column" is defined in a longitudinal direction thereof. However, the column 7 lacks small regions S at four portions thereof corresponding to the rows 0, 1, 6 and 7, so that the total number of small regions is sixty (60). A set of the sixty small regions S comprises a main section 30 of a rectangular shape consisting of 56 small regions S arranged in eight rows and seven columns and a sub-section 31 consisting of four small regions S arranged so as to be outwardly projected from the main section 30 while being contiguous to an outer edge of the main section 30.

The small regions S each include the cathode conductor, emitters and gate constructed as described above. The cathode conductors of the small regions S are connected in common for every row and the gates of the small regions S are connected in common for every column.

The FECs 20 arranged in the form of or divided into the small regions S are driven by an X decoder 40 and a Y decoder 41 shown in FIG. 3, which act as a luminance control means. The X decoder 40 includes output terminals X0 to X7 respectively connected to the columns 0 to 7, resulting in scanning the small regions S for every column. The terminals Y0 to Y7 of the Y decoder 41 are respectively connected to the rows 0 to 7, to thereby scan the cathode conductors of the small regions S for every row. Luminance data for an image to be displayed are input to the X decoder 40 and Y decoder 41 in synchronism with a control signal fed to the deflection electrode.

Table 1 shows relationship between a combination of signals input to the small regions S of the FECs 20 and outputs thereof.

TABLE 1

| X | Y | EMISSION OF ELECTRONS |
|---|---|---|
| 0 | 1 | NO |
| 0 | 0 | NO |
| 1 | 1 | NO |
| 1 | 0 | YES |

As note from TABLE 1, the emitters discharge electron when a signal input from the X decoder 40 to the gate is ON and a signal fed from the Y decoder 41 to the cathode conductor is OFF.

TABLE 2 shows a combination of outputs of the decoder When luminance control is carried out over 16 gradations using the FECs 20 arranged in the form of or divided into the sixty (60) small regions.

TABLE 2

| | Luminance Data | | | | Decoder Output X (Gate) | | | | | | | | Decoder Output Y (Cathode) | | | | | | | |
|---|---|---|---|---|---|---|---|---|---|---|---|---|---|---|---|---|---|---|---|---|
| No | $D_3$ | $D_2$ | $D_1$ | $D_0$ | $X_7$ | $X_6$ | $X_5$ | $X_4$ | X3 | $X_2$ | $X_1$ | $X_0$ | $Y_7$ | $Y_6$ | $Y_5$ | $Y_4$ | $Y_3$ | $Y_2$ | $Y_1$ | $Y_0$ |
| 0 | 0 | 0 | 0 | 0 | 0 | 0 | 0 | 0 | 0 | 0 | 0 | 0 | 1 | 1 | 1 | 1 | 1 | 1 | 1 | 1 |
| 1 | 0 | 0 | 0 | 1 | 0 | 0 | 0 | 1 | 1 | 0 | 0 | 0 | 1 | 1 | 1 | 0 | 0 | 1 | 1 | 1 |
| 2 | 0 | 0 | 1 | 0 | 0 | 0 | 0 | 1 | 1 | 0 | 0 | 0 | 1 | 1 | 0 | 0 | 0 | 0 | 1 | 1 |
| 3 | 0 | 0 | 1 | 1 | 0 | 0 | 0 | 1 | 1 | 0 | 0 | 0 | 1 | 0 | 0 | 0 | 0 | 0 | 0 | 1 |
| 4 | 0 | 1 | 0 | 0 | 0 | 0 | 0 | 1 | 1 | 0 | 0 | 0 | 0 | 0 | 0 | 0 | 0 | 0 | 0 | 0 |
| 5 | 0 | 1 | 0 | 1 | 0 | 0 | 1 | 1 | 1 | 1 | 0 | 0 | 1 | 0 | 0 | 0 | 0 | 0 | 1 | 1 |
| 6 | 0 | 1 | 1 | 0 | 0 | 0 | 1 | 1 | 1 | 1 | 0 | 0 | 1 | 0 | 0 | 0 | 0 | 0 | 0 | 1 |
| 7 | 0 | 1 | 1 | 1 | 0 | 0 | 1 | 1 | 1 | 1 | 0 | 0 | 0 | 0 | 0 | 0 | 0 | 0 | 0 | 1 |
| 8 | 1 | 0 | 0 | 0 | 0 | 0 | 1 | 1 | 1 | 1 | 0 | 0 | 0 | 0 | 0 | 0 | 0 | 0 | 0 | 0 |
| 9 | 1 | 0 | 0 | 1 | 0 | 1 | 1 | 1 | 1 | 1 | 1 | 0 | 1 | 0 | 0 | 0 | 0 | 0 | 0 | 1 |
| 10 | 1 | 0 | 1 | 0 | 0 | 1 | 1 | 1 | 1 | 1 | 0 | 0 | 0 | 0 | 0 | 0 | 0 | 0 | 0 | 0 |
| 11 | 1 | 0 | 1 | 1 | 1 | 1 | 1 | 1 | 1 | 1 | 0 | 0 | 0 | 0 | 0 | 0 | 0 | 0 | 0 | 0 |
| 12 | 1 | 1 | 0 | 0 | 0 | 1 | 1 | 1 | 1 | 1 | 1 | 0 | 0 | 0 | 0 | 0 | 0 | 0 | 0 | 0 |
| 13 | 1 | 1 | 0 | 1 | 1 | 0 | 1 | 1 | 1 | 1 | 1 | 0 | 0 | 0 | 0 | 0 | 0 | 0 | 0 | 0 |
| 14 | 1 | 1 | 1 | 0 | 0 | 1 | 1 | 1 | 1 | 1 | 1 | 1 | 0 | 0 | 0 | 0 | 0 | 0 | 0 | 0 |
| 15 | 1 | 1 | 1 | 1 | 1 | 1 | 1 | 1 | 1 | 1 | 1 | 1 | 0 | 0 | 0 | 0 | 0 | 0 | 0 | 0 |

In the illustrated embodiment, control of luminance is carried out by adjusting the number of small regions S selected to emit electrons. As shown in TABLE 2, 4-bit luminance data indicate sixteen gradations between No. 0 and No. 15 and a combination of signals output from the X decoder 40 and Y decoder 41 is determined for every gradation so that the number of small regions S selected is increased at every rising of the gradation.

Figure 4:
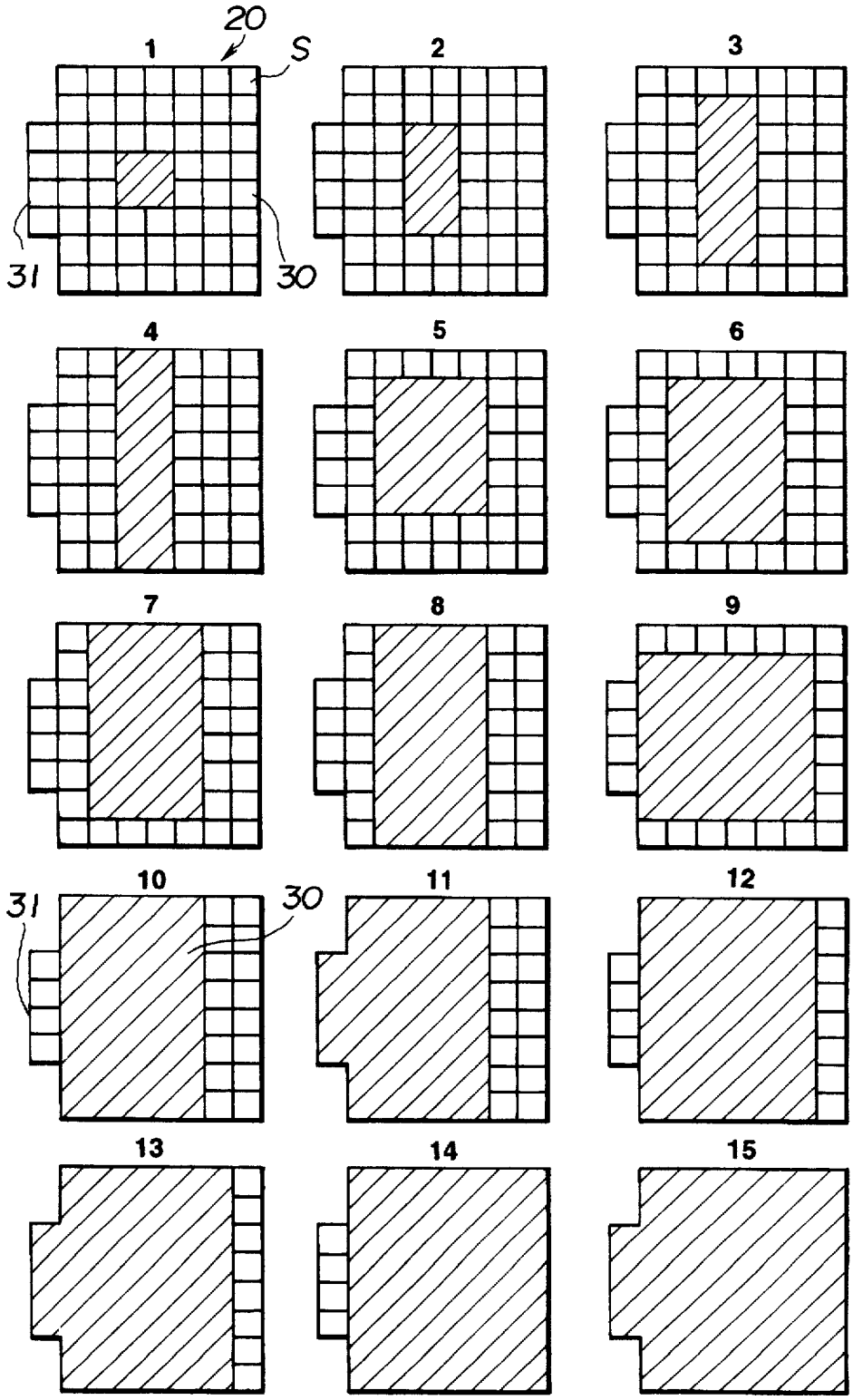
FIG. 4 is a diagrammatic view showing electron emission regions of PECs at each of gradations in an embodiment of a CRT according to the present invention.

According to the decoder signals shown In TABLE 2, the small regions S selected at each of the gradations are arranged as shown in FIG. 4. More particularly, the small regions S selected to emit electrons are expanded from a substantially central portion of the main section 30 toward a periphery thereof with an increase in luminance or an increase in the number of gradations. From gradation No. 11 on, four small regions S of the sub-section 31 are concurrently turned on or turned off at every one gradation. Also, when the sub-section 31 is turned off, the small regions S selected are increased in one column, resulting in the number of small regions S selected being increased, leading to expansion to gradation No. 15.

Thus, in the illustrated embodiment, the FECs 20 are arranged in a form wherein a plurality of the small regions S subject to matrix driving include the sub-section 31. A plurality of the small regions S are gradually selected from a central portion thereof to a portion thereof adjacent to the central portion or the selection is gradually released from the adjacent portion to the central portion, resulting in being varied in gradation, so that the small regions S selected so as to emit electrons form a single set constantly aggregated. This permits electron beams emitted from the FECs 20 to be constantly formed into a minimized spot diameter.

Also, in each of the small regions S of the FBCs 20, a capacitor is defined between the gate and the cathode conductor, 80 that a drive speed at which operation or turning-on and turning-off of electron emission are repeated is subject to restriction. Also, repeating of operation or turning-on and turning-off of the capacitor causes an increase in reactive current and therefore an increase in energy loss, so that an electron gun including FECs generally fails to accommodate to a drive speed required.

In view of the above, the illustrated embodiment is constructed so as to minimize operation or turning-on and turning-off of each of the small regions S. In particular, between gradation No. 10 and gradation No. 15, control takes place using the four small regions of the sub-section 31 so that a variation in rows-and columns of the matrix fed with the signal is minimized. More specifically, the four small regions S of the sub-section 31 and the eight small regions S of one row are alternately operated to lead to a variation in gradations, to thereby minimize a variation in small regions S selected or rows and columns of the small regions S and minimize repeating of operation of the small regions S. Thus, it will be noted that the illustrated embodiment permits the electron gun to be driven at a relatively increases speed while reducing energy loss.

Figure 5:
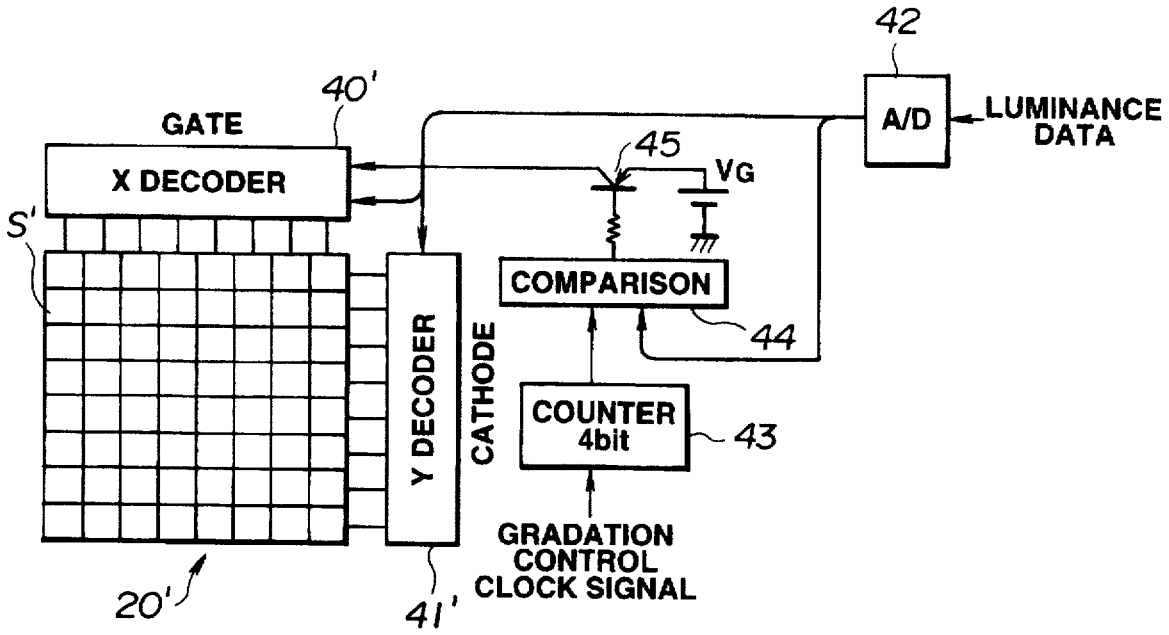
FIG. 5 is a block diagram showing driving of FECs in other embodiment of a CRT according to the present invention.

Referring now to FIG. 5, a luminance control means in another embodiment of a CRT according to the present invention is illustrated. In the above-described embodiment, luminance is controlled by controlling a drive area of field emission cathodes, as well as feeding thereto a signal depending on luminance data. More specifically, it is carried out by feeding a gradation control signal of which a pulse width has been modulated to a gate of each of the field emission cathodes.

An electron gun 12 provided in a CRT 10 of the illustrated embodiment, as shown in FIG. 5, includes in addition to an X decoder 40' and a Y decoder 41' constituting a first luminance control means, a pulse width modulation circuit including a counter 43, a comparison circuit 44 and the like and acting as a second luminance control means.

Luminance data (degradation signal) are fed in the form of analog data to an A/D conversion circuit 42, followed by conversion into 8-bit digital data in the circuit 42. Then, an upper 4-bit portion of the data are fed to the comparison circuit 44 for pulse width modulation.

A CRT controller (not shown) feeds a step-like deflection electrode control signal to a deflection electrode of the CRT, resulting in it being scanned. Also, the CRT controller feeds a gradation control clock signal to the counter 43 constituting a part of a pulse width modulation circuit.

A 4-bit signal generated by the counter 43 is fed to the comparison circuit 44, resulting in being compared with the 4-bit luminance data described above. When the comparison circuit 44 judges that both signals coincide with each other or the luminance data are larger than the 4-bit signal, a switching means 45 arranged between a power supply $V_G$ and the X decoder 40 is controlled to apply a negative potential to a gate 17 of each of the small regions S' of field emission cathodes 20', resulting in keeping an emitter of each of the small regions S' from emitting electrons.

Thus, the luminance data are counted on the basis of the gradation control clock signal, resulting in a gradation control signal (image signal) of which a pulse width has been modulated being produced, which is then fed through the X decoder 40' to the gate 17 of each of the small regions S'. Supposing that the gradation control signal indicates n gradations, the gradation control signal corresponding to one picture cell of the deflection electrode control signal is constituted by a combination of pulses of 1/n in modulation cycle. The gradation control signal is fed to the gates 17 of the electron gun 12 of the CRT 10 in synchronism with feeding of the deflection electrode signal to the deflection electrode of the CRT 10.

In the electron gun 12 of which the gate 17 is fed with the gradation control signal, a period of time during which electrons are emitted is controlled for every picture cell of the panel section 6 being scanned, resulting in luminance being adjusted. Such control of the electron emission time for every cell scanned is never accomplished by the conventional electron gun in which filaments are used as an electron source.

Thus, in the illustrated embodiment, the upper 4-bit portion of the 8-bit luminance data is used for luminance control by the pulse width modulation and a lower 4-bit portion thereof is used for luminance control by control of an electron emission area. Thus, a combination of both luminance controls permits 256 gradations of from 0 to 255 to be represented. Combined use of such two luminance controls permits both controls to cooperate to mutually remedy disadvantages or problems of both, to thereby attain desired luminance control while overcoming difficulties encountered with an increase in the number of gradations by control of the electron emission area and relaxing restrictions due to frequency characteristics during pulse width modulation.

Figure 6:
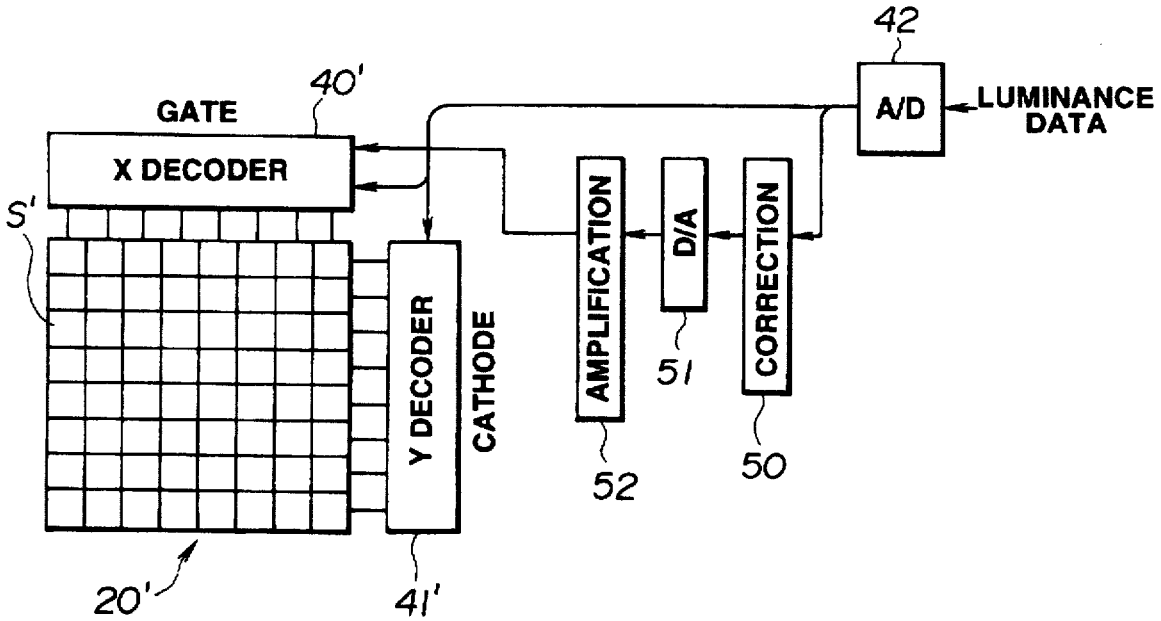
FIG. 6 is a block diagram showing driving of FECs in a further embodiment of a CRT according to the present invention.

Referring now to FIG. 6, a third embodiment of a CRT according to the present invention is illustrated. The third embodiment is adapted to control a drive area of field emission cathodes or FECs to control luminance of the CRT and concurrently apply a voltage signal corresponding to luminance data to gates of PECs to control the luminance. In FIG. 6, both construction and function of an X decoder 40' and a Y decoder 41' which serve as a first luminance control means for PECs 20' may be realized in substantially the same manner as in the second embodiment described above with reference to FIG. 5.

In the illustrated embodiment, luminance control is carried out by controlling a drive area of the FECs 20'. Also, it may be attained by applying an analog gradation control signal produced depending on luminance data to gates 17 of the PECs 20'. Now, luminance control by the analog signal will be described with reference to FIG. 6.

An electron gun 12 provided in a CRT 10 of the illustrated embodiment, as shown in FIG. 6, includes in addition to the X decoder 40' and Y decoder 41' which constitute the first luminance control means, a luminance control circuit including a correction circuit 50, a D/A conversion-circuit 51 and an amplification circuit 52 and serving as a third luminance control means.

Luminance data (gradation signal) which have been provided in the form of analog data and converted into 8-bit digital data by an A/D conversion circuit 42 has an upper 4-bit portion fed to the correction circuit 50. The correction circuit 50 corrects data of a region free of any proportional relationship in gate voltage-emission current characteristics of the PECS.

The above-described control of an emission current from the PECs 20' by the luminance data (gradation signal) which are an analog signal is carried out using a straight region in the gate voltage-emission current characteristics of the FECa 20'. The control in such a manner renders a voltage level of the gradation control signal fed to the gate 17 proportional to the amount of electrons emitted from the FECs 20'. Turning-off of the CRT is carried out by decreasing a voltage of the gradation control signal fed to the gate 17 to a voltage (including 0 V) of a threshold level or below.

A CRT controller (not shown) feeds a step-like deflection electrode control signal to a deflection electrode of a CRT 10, resulting in the electrode being scanned. Luminance data corrected by the correction circuit 50 are then input to the D/A conversion circuit 51, so that the D/A conversion circuit 51 generates an analog gradation control signal of a voltage corresponding to the digital gradation data. The analog gradation control signal is then amplified through an amplifier 52, followed by application to the gate 17 of each of small regions S' through the X decoder 40' in synchronism with feeding of a detection electrode control signal to the deflection electrode of the CRT 10.

In the electron gun 12 of which the gates 17 are fed with the gradation control signal, an electron emission current or the amount of electrons emitted is controlled for every picture cell of the panel section 6, resulting in luminance of the panel section 6 being adjusted. Such control of the electron emission quantity for every picture cell scanned is never attained by the conventional electron gun wherein a filamentary cathode is used as an electron source.

In the illustrated embodiment, the upper 4-bit portion of the 8-bit luminance data is used for luminance control by the analog voltage signal and the lower 4-bit portion thereof is used for luminance control by control of an electron emission area of the FECs 20'. This permits 256 gradations of from 0 to 255 to be realized by a combination of both luminance controls. Combined use of such two luminance controls permits both controls to cooperate to mutually remedy disadvantages or problems of both, to thereby attain desired luminance control while overcoming difficulties encountered with an increase in the number of gradations by control of the electron emission area and relaxing an adverse effect of noise due to a reduction in voltage range for one gradation occurring when gradation control takes place using only an analog signal.

As can be seen from the foregoing, the present invention is so constructed that the field emission cathodes acting as the electron source for the electron gun are arranged in the form of or divided into a plurality of the small regions S for matrix driving, to thereby control luminance of the CRT depending on the number of small regions S selected. Thus, the present invention permits luminance control over any desired number of gradations which exhibits satisfactory resistance to noise and linearity to be realized while simplifying the structure, resulting in the field emission cathodes being highly conveniently applied to an electron gun of a CRT, leading to an improvement in functionality of the CRT. Also, driving of the electron gun in such a manner that the small regions S selected closely aggregate together to constitute one set significantly reduces a diameter of a spot of electron beams, to thereby increase a drive speed.

Also, the present invention includes field emission cathodes functioning as the electron source, so that electron beams which have uniform electron density and are decreased in aberration may be generated by merely providing an electrostatic lens simplified in construction. Also, control of the gates and emitters of the FECE leads to control of emission of electron beams, so that the electron gun may be constructed in a compact manner without arrangement of any additional control electrode.

Furthermore, the present invention is constructed so as to carry out luminance control by a combination of the control means of controlling the drive area of the field emission cathodes and the control means of applying a signal depending on luminance data to the gates of the field emission cathodes, so that both control means may cooperate to mutually remedy disadvantages of both, to thereby permit advantages of the CRT including the electron gun to be maximized.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A cathode ray tube comprising:

an electron gun including field emission cathodes each including a cathode conductor, emitters provided on said cathode conductor and a gate disposed in proximity to said emitters;

said field emission cathodes being arranged in the form of small regions defined in a matrix-like manner;

a deflection electrode for deflecting electron beams emitted from said electron gun; and a luminance control means for driving said cathode conductor and gate of each of said small regions for every row or column of the matrix in said electron gun to control a drive area of each of said field emission cathodes by forming a continuous single aggregate of said small regions having a minimum-spot diameter, resulting in controlling luminance.

2. A cathode ray tube as defined in claim 1, wherein said luminance control means adjusts luminance by controlling the drive area of each of said field emission cathodes and concurrently applying a signal depending on luminance data to said gate of each of said field emission cathodes.

3. A cathode ray tube as defined in claim 2, wherein said luminance control means adjusts luminance by controlling the drive area of each of said field emission cathodes and concurrently applying a signal of which a pulse width is modulated depending on luminance data or a signal of a voltage depending on the luminance data to said gate of each of said field emission cathodes in synchronism with a control signal of said deflection electrode.

4. A method for driving a cathode ray tube which includes an electron gun including a plurality of field emission cathodes each including a cathode conductor, emitters provided on said cathode conductor and a gate disposed in proximity to said emitters and arranged in the form of small regions defined in a matrix-like manner, a deflection electrode for deflecting electron beams emitted from said electron gun and a panel section having phosphors which emit light due to impingement of electron beams thereon deposited thereon, comprising the step of driving said cathode conductor and gate of each of said small regions for every row or column of the matrix in said electron gun to control a drive area of each of said field emission cathodes by forming a continuous single aggregate of said small regions having a minimum spot diameter, resulting in controlling luminance.

5. A method as defined in claim 4, wherein luminance control is carried out by driving said cathode conductor and gate of each of said small regions for every row or column of the matrix in said electron gun to control a drive area of each of said field emission cathodes and applying a signal of which a pulse-width is modulated depending on luminance data or a signal of a voltage depending on the luminance data to said gate of each of said field emission cathodes in synchronism with a control signal of said deflection electrode.

6. A method for driving a cathode ray tube which includes an electron gun including a plurality of field emission cathodes each including a cathode conductor, emitters provided on said cathode conductor and a gate disposed in proximity to said emitters and arranged in the form of small regions defined in a matrix-like manner, a deflection electrode for deflecting electron beams emitted from said electron gun, a panel section having phosphors which emit light due to impingement of electron beams thereon deposited thereon and a luminance control means for driving said cathode conductor and gate of each of said small regions for every row or column of the matrix in said electron gun to select the small regions, comprising the step of controlling a drive area of each of said field emission cathodes to control luminance by forming a continuous single aggregate of said small regions having a minimum spot diameter.

7. A method as defined in claim 6, wherein luminance control is carried out by driving said cathode conductor and gate of each of said small regions for every row or column of the matrix in said electron gun to control a drive area of each of said field emission cathodes and applying a signal of which a pulse width is modulated depending on luminance data or a signal of a voltage depending on the luminance data to said gate of each of said field emission cathodes in synchronism with a control signal of said deflection electrode.

* * * * *